US005271309A

United States Patent [19]

Cornett

[11] Patent Number: 5,271,309

[45] Date of Patent: Dec. 21, 1993

[54] CARTRIDGE RETAINING MEANS FOR A HAMMER-ACTIVATED POWDER-ACTUATED FASTENING TOOL

[75] Inventor: Roger D. Cornett, Bowling Green, Ky.

[73] Assignee: DESA International, Inc., Bowling Green, Ky.

[21] Appl. No.: 909,141

[22] Filed: Jul. 6, 1992

[51] Int. Cl.[5] ..... B25C 1/14

[52] U.S. Cl. ..... 89/1.14; 227/10

[58] Field of Search ..... 42/69.01; 89/1.14; 227/9, 10

[56] References Cited

U.S. PATENT DOCUMENTS

| | | | |
|---|---|---|---|
| 4,025,029 | 5/1977 | Kotas et al. | 277/10 |
| 4,252,259 | 2/1981 | Brosius | 227/10 |
| 4,830,252 | 5/1989 | Gottlieb et al. | 227/10 |
| 4,890,778 | 1/1990 | Hawkins | 227/10 |

*Primary Examiner*—David H. Brown

*Attorney, Agent, or Firm*—Michael E. McKee

[57] ABSTRACT

A hammer-actuated fastening tool utilizing a powder cartridge for driving a fastener into a workpiece upon discharge of the cartridge includes a retainer clip for maintaining the cartridge in its operative position within the tool for discharge of the cartridge. The tool includes a housing within which a fastener is positionable, a cartridge-holding body supported within the housing defining a bore within which a cartridge is operatively positionable, and an elongated firing pin for transferring the impact of a hammer to the cartridge for discharging the cartridge. A guide member body is positioned about the firing pin for guiding the firing pin relative to the cartridge-holding body from a first position to a second position at which the impact of the hammer is transferred to a cartridge positioned within the cartridge-holding body. The retainer clip is attached to the guide member body so as to be interposed between the firing pin and a cartridge positioned within the bore of the cartridge-holding body.

14 Claims, 3 Drawing Sheets

CARTRIDGE RETAINING MEANS FOR A HAMMER-ACTIVATED POWDER-ACTUATED FASTENING TOOL

BACKGROUND OF THE INVENTION

This invention relates generally to hammer-activated, powder-actuated fastening tools and relates, more particularly, to such fastening tools which utilize a powder cartridge for providing, upon discharge of the cartridge, the driving power applied to a fastener.

The tool with which this invention is concerned includes an elongated housing within which a fastener, such as a nail or stud, is positionable, cartridge-holding means defining a bore within which a powder cartridge is operatively positionable, and an elongated firing pin for transferring the impact of a hammer to the cartridge for the purpose of discharging the cartridge. The tool also includes means for guiding the firing pin relative to the cartridge as the pin is moved from a first position at which the forward end of the firing pin is spaced from the cartridge to a second position adjacent the cartridge. By striking the rear end of the firing pin with a hammer, the firing pin moves from its first position to its second position to thereby transfer the impact of the hammer to the cartridge through the forward end of the pin. An example of a fastening tool of this class is shown and described in U.S. Pat. No. 4,025,029.

Commonly, such a tool includes no means for ensuring that the cartridge, once placed within the bore of the cartridge-holding means, is maintained in its desired position prior to discharge. Consequently, the cartridge may back out of the bore or otherwise shift in position relative thereto so as not to be properly seated within the bore when the cartridge is discharged. If the cartridge is discharged when improperly seated, the spent cartridge may jam within the bore rendering subsequent removal of the cartridge difficult. Of course, unless the spent cartridge is removed from the bore, the tool cannot be re-used.

Accordingly, it is an object of the present invention to provide a tool of the aforedescribed class having new and improved means for maintaining a powder cartridge in a properly seated position within the tool prior to discharge of the cartridge.

Another object of the present invention is to provide such a tool including means for ensuring that the cartridge is positioned in its proper position within the tool prior to discharge so that the cartridge is less likely to jam within the tool following discharge of the cartridge.

Yet another object of the present invention is to provide such a tool which is uncomplicated in construction and effective in operation.

SUMMARY OF THE INVENTION

This invention resides in a hammer-actuated fastening tool utilizing a powder cartridge for driving a fastener into a workpiece upon discharge of the cartridge. The tool includes a housing within which a fastener is positionable, cartridge-holding means supported within the housing defining a bore within which a cartridge is operatively positionable, and elongated firing means for transferring the impact of a hammer to the cartridge for discharging the cartridge. The firing means has a rear end for receiving the impact of a hammer and an opposite forward end, and the tool includes means for guiding the firing means relative to the cartridge-holding means from a first position to a second position at which the impact of the hammer is transferred to a cartridge positioned within the cartridge-holding means through the forward end of the firing means.

The improvement comprises retaining means supported within the housing for maintaining the cartridge in its operative position within the bore of the cartridge-holding means until discharged. Because the cartridge is maintained in its operative position by the retaining means, the cartridge is prevented from backing out of the bore or otherwise shifting in position relative thereto so as not to be properly seated within the bore when the cartridge is discharged.

DETAILED DESCRIPTION OF THE ILLUSTRATED EMBODIMENTS

Figure 1:
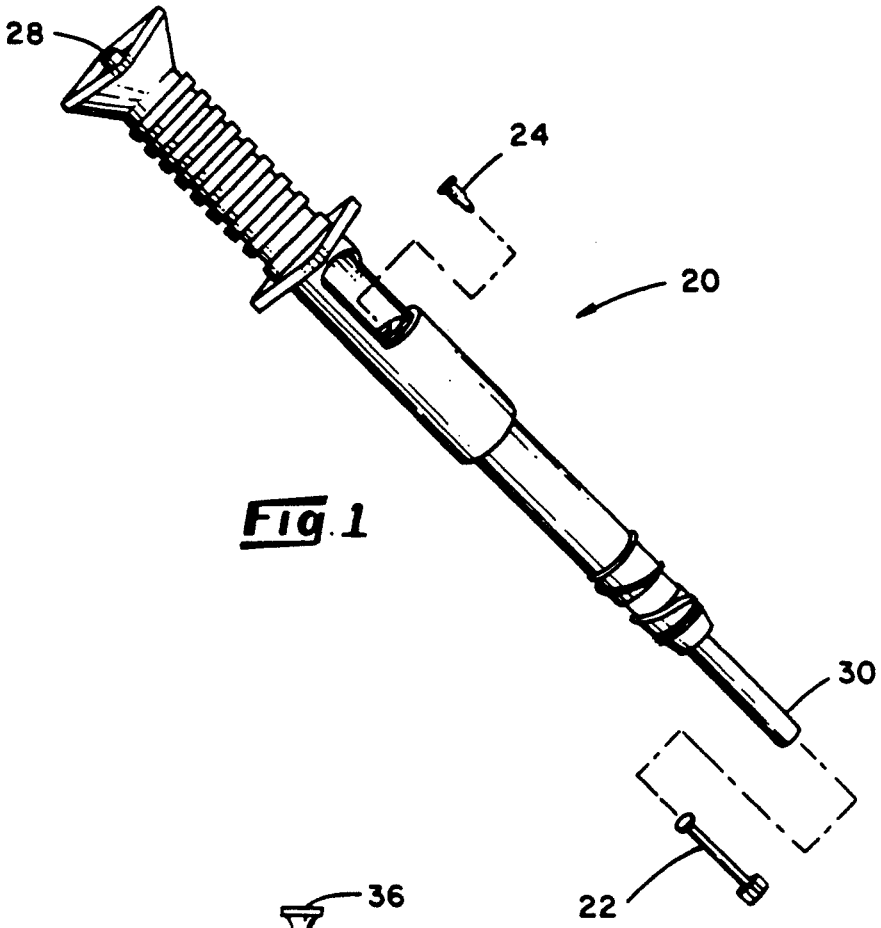
FIG. 1 is a perspective view of an embodiment of a tool and a fastener and powder cartridge utilized with the tool.
Figure 5:
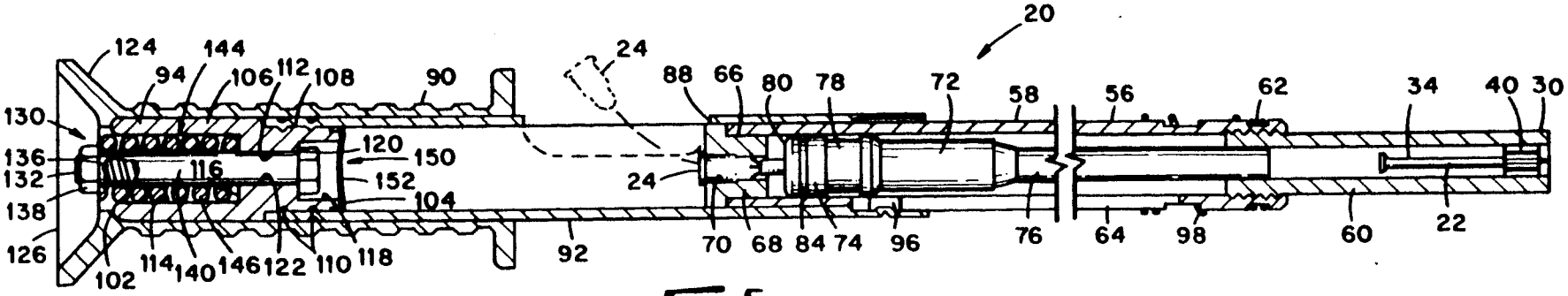
FIG. 5 is a longitudinal cross-sectional view, shown partially cut-away, of the FIG. 1 tool shown in condition for loading a cartridge within the tool.

Turning now to the drawings in greater detail and considering first FIG. 1, there is illustrated a hammer-activated, powder-actuated fastening tool 20, a fastener 22 of the type intended to be driven by the tool 20 into a workpiece and a powder cartridge 24 for providing the power with which the fastener 22 is driven into the workpiece. The tool 20 is elongated in shape and has an end 28 against which a hammer or similar tool (not shown) is struck during use of the tool 20 and an opposite end 30 from which the fastener 22 is driven from the tool 20 and into the workpiece. In preparation of the tool 20 for use, the cartridge 24 is loaded within the tool 20 into a position illustrated in solid lines in FIG. 5 and the fastener 22 is inserted head-end-first into the tool end 30 as shown in FIG. 5. The tool 20 is then supported with a hand adjacent a workpiece 32 (FIG. 6) so that the tool end 30 engages the workpiece 32 and so that the fastener 22 is directed toward the workpiece location through which the fastener 22 is desired to be driven. The tool end 28 is then struck with the hammer to discharge the cartridge 24 and so that the gases generated by the discharge of the cartridge 24 drives the fastener 22 into the workpiece 32.

Figure 2:
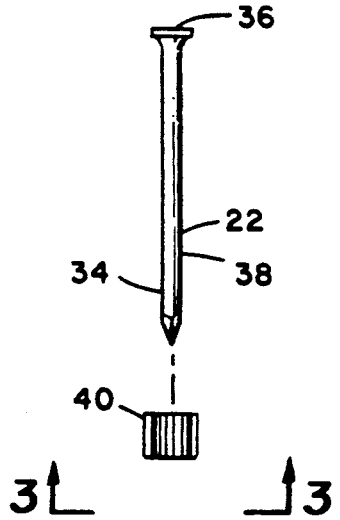
FIG. 2 is an elevational view of the fastener illustrated in FIG. 1, but drawn to a larger scale and shown exploded.
Figure 3:
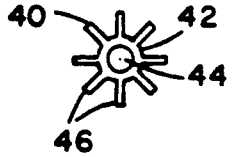
FIG. 3 is a plan view of a component of the FIG. 2 fastener as viewed along line 3—3 of FIG. 2.

As illustrated in FIG. 2, the fastener 22 suitable for use in the tool 20 is an assembly including a nail 34 having a head 36 and a shank 38 and including a guide member 40 secured about the nail 34. As best shown in FIG. 3, the guide member 40 includes a body of elastomeric material, such as plastic, having a central portion 42 having an opening 44 through which the shank 38 of the nail 34 is positioned and a plurality of radially-extending fins 46 regularly spaced about the central portion 42. The guide member 40 is sized so that its overall diameter is slightly greater than the inner diameter of the tool end 30. Therefore, upon insertion of the fastener 22 within the tool end 30 to the position illustrated in FIG. 5, the fins 46 of the guide member 40 are flexed slightly inwardly so that the fastener 22 is snugly retained within the tool end 30 by the flexed condition of the guide member 40.

Figure 4:
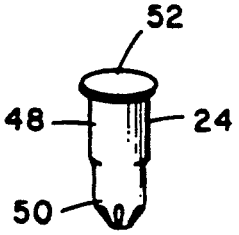
FIG. 4 is a perspective view of the powder cartridge illustrated in FIG. 1, but drawn to a larger scale.

As illustrated in FIG. 4, the powder cartridge 24 suitable for use in the tool 20 includes a casing 48 containing an amount of powder and primer and is commonly referred to as a rim-fire cartridge. The casing 48 has a nose end 50 and a rear end 52 having a rim, and the primer is retained within the casing 48 adjacent the rim so that upon exposure of the rim to an impact sufficient to deform the rim, the cartridge 24 discharges. Upon discharge of the cartridge 24, the gases generated as a result thereof abruptly exit the nose end 50 of the casing 48 for the purpose of driving the fastener 22 from the tool end 30.

Figure 6:
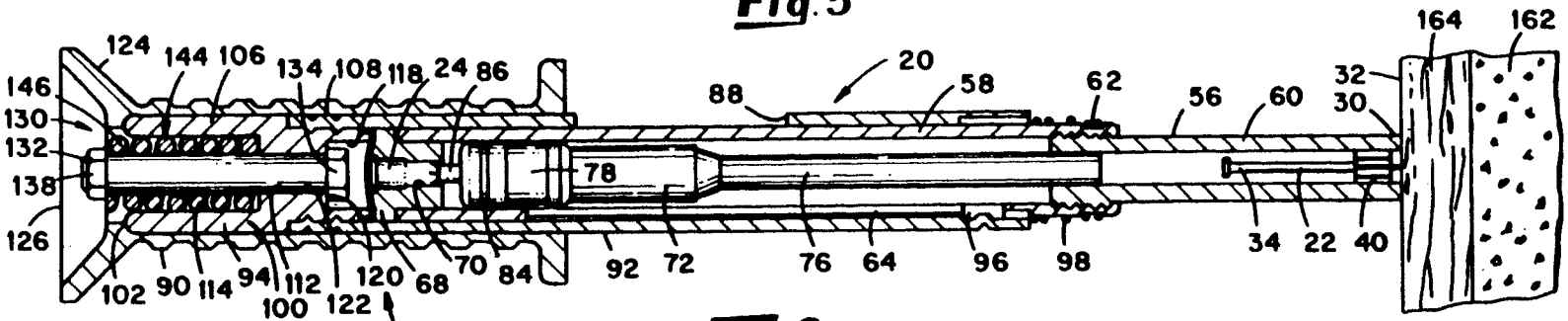
FIG. 6 is a view similar to that of FIG. 5 illustrating the tool when in a ready-to-fire condition.
Figure 7:
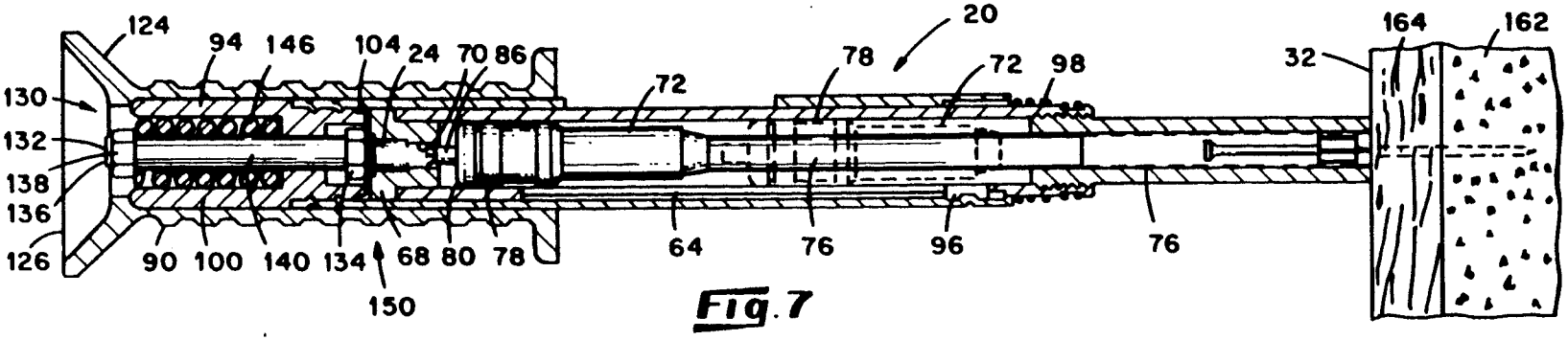
FIG. 7 is a view similar to that of FIG. 6 illustrating the position of the firing pin of the FIG. 1 tool when moved within the tool so as to discharge the powder cartridge.

With reference to FIGS. 5–7, the tool 20 includes a tubular housing assembly 56 within which the fastener 22 is positioned for use of the tool 20. The housing assembly 56 includes a main tube 58 and a muzzle tube 60 having an end portion which is fixedly secured within an end portion of the main tube 58 as illustrated in FIG. 5 so that a major portion of the muzzle tube extends from the main tube 58. The muzzle tube 60 provides the end 30 of the tool 20 within which the fastener 22 is positioned for use of the tool 20, and the main tube 58 includes an annular groove 62 in its outer surface within which an end of a spring is retained. The main tube 58 also includes a linear groove 64 extending along one side thereof for a purpose apparent herein.

With reference still to FIG. 5, the tool 20 also includes cartridge-holding means 66 for holding the cartridge 24 within the tool 20 for firing. In the depicted tool 20, the cartridge-holding means 66 includes a body 68 of material, preferably steel, which is fixedly secured within the main tube 58 adjacent the end thereof opposite the muzzle tube 60 and includes a central bore 70 for accepting a cartridge 24 inserted nose-end-first therein. The bore 70 includes sections which are sized to accommodate the different sized sections of the cartridge 24 and an enlarged entrance section sized to accept the lip of the rim of the cartridge casing 48. In the interests of the present invention, a cartridge 24 is operatively positioned within the bore 70 when the cartridge 24 is seated within the bore 70 so that the lip of the casing 48 is positioned in abutting relationship with the cartridge-holding body 68. In its operative position within the bore 70, a portion of the rim of cartridge 24 extends slightly beyond the entrance of the bore so that the rim is exposed for firing purposes. Upon discharge of the cartridge 24, gases which are forced to exit the nose end of the cartridge 24 exit the cartridge-holding body 68 through the right end, as viewed in FIG. 5, of the bore 70.

The tool 20 also includes a piston assembly 72 slidably positioned within the housing assembly 56 for transmitting the force of the gases exiting the cartridge casing 48 to the fastener 22. The piston assembly 72 includes an elongated head 74 and a rod 76 integrally joined together in an end-to-end manner. The head 74 includes a plug-like body 78 having a face end 80 which generally faces the cartridge-holding body 68 and outer dimensions which are sized to be received by the interior of the main tube 58. The piston body 78 also includes an annular groove for accepting a wire ring 84 positioned thereabout to thereby seal the space between the body 78 and the interior of the main tube 58. The rod 76 is slidably positioned within the interior of the muzzle tube 60 and, accordingly, has a diameter which is slightly smaller than that of the inner diameter of the muzzle tube 60.

The piston head 74 also includes a central protuberance 86 extending axially from the face end 80 for acceptance by the bore 70 of the cartridge-holding body 68. Upon return of the piston assembly 78 to a ready-to-fire position within the housing assembly 56 following discharge of the cartridge 24, the protuberance 86 enters the bore 70 of the cartridge-holding body 68 and urges the spent casing 48 from the bore 70 through the opposite end of the cartridge-holding body 68.

When the piston assembly 72 is positioned within the housing assembly 56 in a ready-to-fire position as is shown in FIG. 5, the piston head 74 is slidably positioned within the main tube 58 so that its face end 80 is positioned in relatively close proximity to the cartridge-holding body 68 and the rod 76 extends a relatively short distance into the muzzle tube 58. The interior space of the muzzle tube 58 left unoccupied by the rod 76 is of sufficient size to accommodate the fastener 22 inserted therein. Upon discharge of a cartridge 24 within the tool 20, the piston assembly 72 moves along the housing assembly 56 to an extended position as illustrated in phantom in FIG. 7 where the advance of the piston assembly 72 along the length of the housing assembly 56 is halted by the surface of the workpiece 32. The assembly 72 is prevented from being totally removed from the housing assembly 56 due to the large size of the piston head 74 in relation to the inside dimension of the muzzle tube 60.

With reference again to FIG. 5, the tool 20 includes a guide assembly 90 connected to the housing assembly 56 and adapted to be gripped by the hand during use of the tool 20. The guide assembly 90 includes a sleeve 92 positioned about the main tube 56 and a guide member 94 positioned within the sleeve 92. The sleeve 92 includes an opening 88 provided along a side thereof and is positioned about the main tube 58 to accommodate a sliding movement of the sleeve 92 relative to and along the length of the main tube 58. A spring lock 96 is affixed within the sleeve 92 and is partially positioned within the linear groove 64 provided in the side of the main tube 58 to prevent the removal of the sleeve 92 from the main tube 58 and to prevent the rotation of the sleeve 92 about the main tube 58. As the sleeve 92 is slidably moved along the length of the main tube 58, the spring lock 92 is guided along the linear groove 64. A compression spring 98 is fixed at one end within the annular groove 62 of the main tube 58 and positioned about the main tube 58 so as to act between the sleeve 92 and the tube 58. When using the tool 20, the spring 98 requires that the guide assembly 90 be urged along the length of the housing assembly 56 with a predetermined, or minimum, amount of force to ready the tool 20 for firing.

Figure 8:
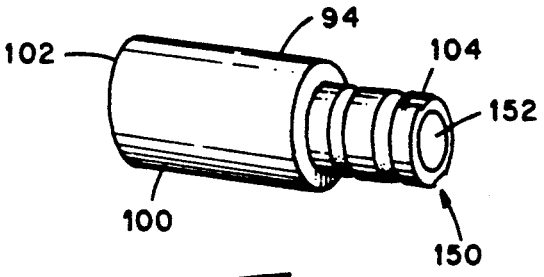
FIG. 8 is a perspective view of guide means for guiding the movement of the firing pin of the FIG. 1 tool through the tool.
Figure 9:
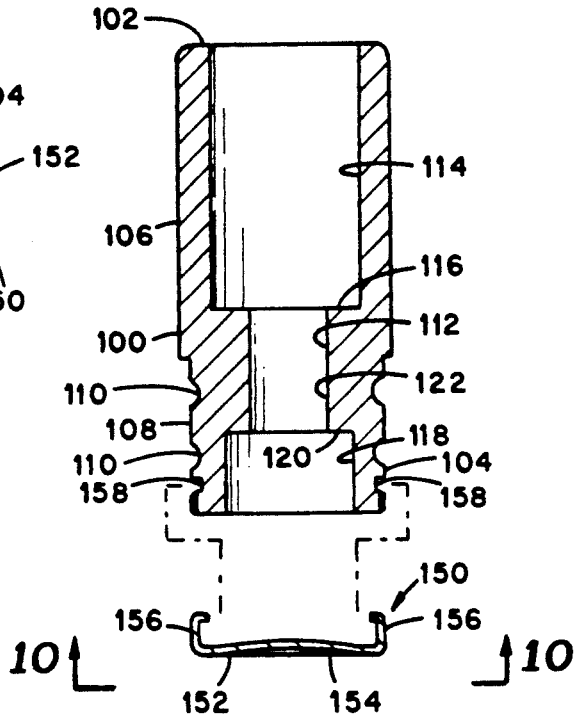
FIG. 9 is a longitudinal cross-sectional view of the guide means of FIG. 8.

With reference to FIGS. 8 and 9, the guide member 94 includes a body 100 constructed, for example, of a zinc alloy and having two opposite ends 102 and 104. The body 100 of the guide member 94 includes a cylindrical end portion 106 adjacent its end 102 and having an outer diameter which generally corresponds with the outer diameter of the sleeve 92 and a cylindrical end portion 108 adjacent its end 104 of reduced diameter. More specifically, the reduced end portion 108 is sized to be closely received by the sleeve 92 of the guide assembly 90 as shown in FIG. 5. The reduced end portion 108 is provided with a pair of annular grooves 110 and is joined to the sleeve 92 by means of an amount of material of the sleeve 92 which has been machine-rolled so as to be received by the annular grooves 110.

The guide body 100 also includes a central passageway 112 extending between the body ends 102, 104. The passageway 112 includes a first enlarged section 114 opening out of the body end 102 and terminating in a shoulder 116 and a second enlarged section 118 opening out of the opposite body end 104 and terminating in a shoulder 120. Extending between the shoulders 116 and 118 is a central bore section 122 having a smaller diameter than that of the enlarged sections 114, 118.

To facilitate the grasping of the guide assembly 90 for use of the tool 20, the tool 20 includes a grip 124 fixedly secured about the guide member 94 and an adjacent portion of the sleeve 92. The grip 124 is comprised of an elastomeric material and has an end 126 adjacent the tool end 28 which is open for a reason apparent herein.

The guide assembly 90 is slidably movable relative to and along the length of the housing assembly 56 between a retracted condition as illustrated in FIG. 5 and a ready-to-fire condition as illustrated in FIG. 6. In the FIG. 5 retracted condition, the guide member body 100 is spaced a considerable distance from the cartridge-holding body 68 and the opening 88 provided along a side of the sleeve 92 provides access to the cartridge-holding body 68 for the purposes of placing a cartridge 24 within the bore 70 of the body 68 and accommodates removal of a spent casing 48 following discharge of the cartridge 24. In the FIG. 6 ready-to-fire condition, the end 104 of the guide member body 100 is positioned adjacent the cartridge-holding body 68 so that the passageway 112 of the guide body 100 is positioned in registry with the rear end of the cartridge 24 positioned within the bore 70.

The tool 20 also includes firing pin means, generally indicated 130, for transferring the impact force of a hammer to the cartridge 24 for the purpose of discharging the cartridge 24. In the depicted tool 20, the firing pin means 130 includes a bolt 132 having a head 134 and a threaded shank 136 and includes a nut 138 threadably secured upon the shank 136. The bolt 132 is positioned within the body 100 of the guide member 94 so that its shank 136 is loosely received by the passageway 112 of the body 100 and so that the head 134 is positioned within the enlarged section 118 provided adjacent the body end 104. In the depicted tool 20, a sleeve member 140 is positioned within the passageway 112 and the bolt shank 136 extends through the sleeve member 140 so that the walls of the sleeve member 140 are disposed between the walls of the passageway 112 and the surface of the shank 136. The nut 138 is tightened upon the shank 136 and against the end of the sleeve member 140. During use of the tool 20, the bolt 132 is slidably movable relative to and along the length of the passageway 112 between a retracted position, as illustrated in FIG. 6, at which the bolt head 134 is positioned adjacent the shoulder 120 and an extended position, as illustrated in FIG. 7, at which the head 134 is positioned adjacent the end 102 of the guide member body 100.

The tool 20 also includes means, generally indicated 144, for biasing the bolt 132 from its FIG. 7 extended position toward its FIG. 6 retracted position. In the depicted tool 20, the biasing means 144 is in the form of a compression spring 146 positioned about the shank 136 of the bolt 132 so that one end of the spring 146 engages the nut 138 and the other end of the spring 146 engages the shoulder 116 of the guide member body 100. Accordingly, the spring 146 is sized to loosely accept the sleeve member 140 to be received by the enlarged section 114 of the guide member body 100.

The spring 146 is compressed between the nut 138 and the shoulder 116 so that the spring 146 continually urges the head 134 of the bolt 132 toward its retracted position of FIGS. 5 and 6. Preferably, the strength of the spring 146 is preselected so that by tightening the nut 138 upon the sleeve member 140, the spring 146 exerts a desired preset force upon the bolt 132. It is preferred that this preset force is sufficient to minimize inadvertent discharge of the cartridge 24, if, for example, the tool 20 is dropped upon a floor, but it will be understood that this preset force must be overcome by the impact of a hammer during use of the tool 20 before the bolt head 134 can be moved from its retracted position of FIGS. 5 and 6 to its extended position of FIG. 7.

Figure 10:
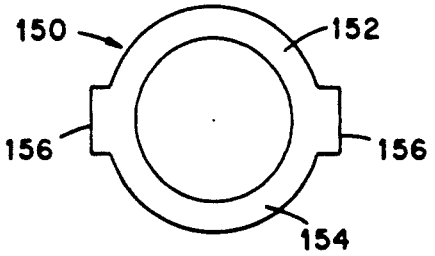
FIG. 10 is a plan view of the clip of the FIG. 8 assembly as viewed along line 10—10 of FIG. 9.

The tool 20 also includes retaining means, generally indicated 150, for maintaining the cartridge 24 in its operative position within the bore 70 of the cartridge-holding body 68 for use of the tool 20. In the tool 20, the retaining means 150 is in the form of a retainer clip 152 attached to the end 104 of the guide member body 100 so as to span the passageway opening provided therein. As best shown in FIGS. 8–10, the retainer clip 152 includes a thin platen portion 154 which is circular in form and two tabs 156 which are joined to the platen portion 154 on opposite sides thereof. For securement of the clip 152 to the guide member body 100, the body 100 is provided with a pair of indentations 158 disposed on opposite sides thereof and adjacent the body end 104, and the tabs 156 cooperate with the indentations 158 to join the clip 152 to the body 100. More specifically, the tabs 152 are bent out of the general plane of the platen portion 154 into an L-shaped configuration as shown in FIG. 9 so that by urging the clip 152 over the body end 154 so that the tabs 156 move along the sides of the body 100, the tabs 152 move into snap fit relationship with the indentations 158 to thereby lock the clip 152 in its desired position upon the body 100 as illustrated in FIG. 8.

The clip 152 is constructed of a resiliently flexible material, such as annealed spring steel (e.g., C1075 cold rolled steel) and has a thickness, as measured through the platen portion 154, of about $0.015 \pm 0.001$ inches. Furthermore, the platen portion 154 possesses a slight concavity as a path is traced thereacross so that the platen portion 154 is slightly arcuate in shape as viewed in the cross-sectional view of FIG. 9. When the guide member body 100 is positioned within the tool 20 with the clip 152 attached thereto, the platen portion 154 of the clip 152 is interposed between the cartridge-holding body 68 and the bolt head 134 as shown in FIG. 6.

To use the tool 20, the guide assembly 90 and housing assembly 56 are moved relative to one another to the illustrated FIG. 5 position at which the bore 70 of the cartridge-holding body is accessible through the opening 88 provided in one side of the sleeve 92. The cartridge 24 is then placed into the bore 70 by inserting the cartridge 24 nose-end-first from a position shown, for example, in phantom in FIG. 5, to its operative position within the bore 70 as illustrated in solid lines in FIG. 5. A fastener 22 is also inserted head-end-first into the muzzle tube 60 to the FIG. 5 position where it is retained therein by the aforementioned cooperation between the guide member 40 and the inside walls of the muzzle tube 60.

The guide assembly 90 and housing assembly 56 are thereafter moved relative to one another to position the guide member body 100 adjacent the rear of the cartridge 24 in the ready-to-fire condition illustrated in FIG. 6. The tool 24 is thereafter placed against the surface of a workpiece 32, illustrated in FIGS. 6 and 7 as comprised of a concrete layer 162 overlain by a piece of wood 164, so that the fastener 22 is directed generally toward the location on the surface of the workpiece 32 through which the nail 34 of the fastener 22 is desired to be driven. As the tool 20 is held in position against the workpiece 32 (as the grip 124 is held with one hand), the nut-end of the bolt 132 is struck with a hammer or similar tool through the open end 126 of the grip 124 so that the bolt head 132 is driven against and discharges the cartridge 24. Upon discharge of the cartridge 24, gases exiting the cartridge casing 48 force the piston assembly 72 relative to and along the length of the muzzle tube 60 to the position illustrated in phantom in FIG. 7 so that the fastener nail 34 is driven by the piston assembly 72 into the workpiece 32 to the position illustrated in phantom in FIG. 7. The guide member 40 of the fastener 22 is forced to exit the muzzle tube 60 with the nail 34 but is commonly crushed between the surface of the workpiece and the head of the nail 34 as the nail 34 is driven into the workpiece 32.

It follows that as the guide assembly 90 is moved along the housing assembly 56 to the ready-to-fire condition of FIG. 6, the clip 152 is moved into engagement with the rear of the cartridge 24 so as to span the cartridge 24. The aforedescribed concavity of the platen portion 154 of the clip 152 accommodates the small projection of the rim of the cartridge 24 from the bore 70 and enables the end 104 of the guide member body 100 to stably abut the edges of the cartridge-holding body 68 prior to the exposure of a hammer-applied force to the bolt 132. Thus, the clip 52 provides a backing for the cartridge 24 prior to discharge so that as long as the guide assembly 90 is maintained in its FIG. 6 ready-to-fire condition, the cartridge 24 is prevented from sliding or shifting out of its operative position within the bore 70 by the clip 152.

Upon striking of the nut-end of the bolt 132 with a hammer, the bolt 132 shifts to the position of FIG. 7 at which the head 134 impacts the platen portion 154 of the clip 152 and deforms the rim of the cartridge (i.e., discharges the cartridge 24) through the platen portion 154. As the bolt head 134 deforms the cartridge rim, the platen portion 154 is flexed to a relatively flat condition between the bolt head 134 and the cartridge 24 and exposes the rim of the cartridge 24 to substantially the entire force of impact of the bolt head 134 exerted upon the clip 152. Following discharge of the cartridge 24 and return of the bolt 134 by means of the spring 146 to its FIG. 6 retracted position, the memory of the clip 152 returns the platen portion 154 of the clip 152 to its unflexed, concave condition illustrated in FIG. 6.

Figure 11:
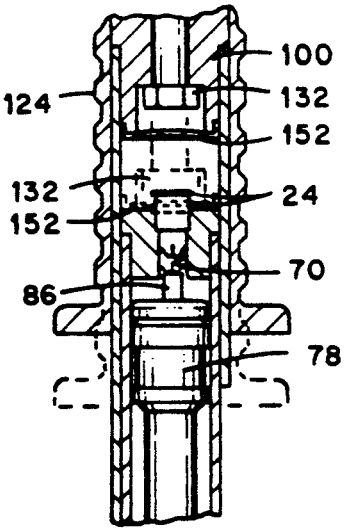
FIG. 11 is a view similar to that of FIG. 6 of a fragment of the FIG. 1 tool within which a cartridge is shown improperly seated within the tool.

Another advantage provided by the retainer clip 152 relates to the fact that as the retainer clip 152 is urged against the cartridge-holding body 68 as the guide assembly 90 is moved to its ready-to-fire condition, a cartridge 24 which has not been properly placed within the cartridge-holding body 68 is urged by the retainer clip 152 into its operative, seated condition within the bore 70. For example, there is illustrated in FIG. 11, a cartridge 24 which has been placed within the tool 20 so as to be canted with respect to the longitudinal axis of the bore 70. Upon subsequent movement of the guide assembly 90 from its retracted (FIG. 5) condition to its (FIG. 6) ready-to-fire condition, the retainer clip 152 engages the rear end of the cartridge 24 and urges the cartridge 24 into its operative, seated condition illustrated in phantom in FIG. 11. It follows that the retainer clip 152 ensures that the cartridge 24 is properly seated within the bore 70 of the cartridge-holding body 68 prior to discharge of the cartridge 24.

Following the use of the tool 20, the piston assembly 72 can be returned to its FIG. 6 position adjacent the cartridge-holding body 68 by moving the guide assembly 90 relative to the housing assembly 56 to its FIG. 5 retracted position. As the guide assembly 90 is moved in this manner, the spring lock 96 cooperates with the piston head 74 to return the piston assembly 72 to its FIG. 6 condition as the spring lock is slidably moved along the groove 64. Before the spring locks 96 reaches its leftwardmost, as viewed in FIG. 5, limit of travel, the central protuberance 86 of the piston head 72 extends into the cartridge-holding bore 70 and urges the spent cartridge 24 from the bore 70 where it may exit the tool 20 through the sleeve opening 88. Since the cartridge 24 is discharged while properly seated within the tool 20, the likelihood that the spent cartridge will jam within the bore is significantly reduced. With the cartridge casing 48 removed from the bore 70, the tool 20 is in condition to be prepared for re-use.

Figure 12:
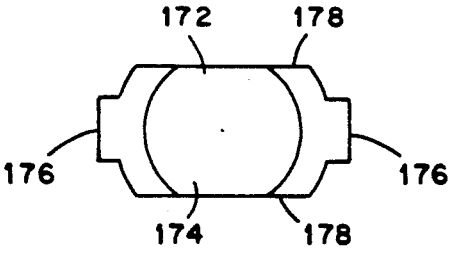
FIG. 12 is a view similar to that of FIG. 10 of an alternative clip for the FIG. 8 assembly.

It will be understood that numerous modifications and substitutions may be had to the aforedescribed embodiment without departing from the spirit of the invention. For example, although the retainer clip 152 of the aforedescribed tool 20 has been shown and described as being circular in shape so as to span the end 104 of the guide member body 100, a retainer clip in accordance with the broader aspects of this invention may possess an alternative form. For example, there is illustrated in FIG. 12 an alternative retainer clip 172 having a platen portion 174 and a pair of tabs 176 joined to the platen portion 174 on opposite sides thereof. The platen portion 174 is not circular in form as is platen portion 154 of the FIG. 10 clip 152 but instead has a pair of opposite side edges 178 which are substantially straight and parallel to one another. Accordingly, the aforedescribed embodiment is intended for the purpose of illustration and not as limitation.

I claim:

1. In a hammer-actuated fastening tool utilizing a powder cartridge for driving a fastener into a workpiece upon discharge of the cartridge including a housing within which a fastener is positionable, cartridge-holding means supported within the housing defining a bore within which a cartridge is operatively positionable, elongated firing means for transferring the impact of a hammer to the cartridge for discharging the cartridge wherein the firing means has a rear end for receiving the impact of a hammer and an opposite forward end, means for guiding the firing means relative to the cartridge-holding means from a first position to a second position at which the impact of the hammer is transferred to a cartridge positioned within the cartridge-holding means through the forward end of the firing means to discharge the cartridge and wherein the powder cartridge has a rear which is adapted to be struck in order to discharge the cartridge, the improvement comprising:

retaining means supported within the housing for maintaining the cartridge in its operative position within the bore of the cartridge-holding means until discharged;

the guide means and cartridge-holding means are movable relative to one another from a first condition accommodating the placement of the cartridge within the bore of the cartridge-holding means to a ready-to-fire condition at which the guide means is positioned adjacent the cartridge-holding means so that the firing means is positioned relative to the cartridge in its first position;

the retaining means is associated with the guide means and includes means interposed generally between the forward end of the firing means and the cartridge-holding means so that movement of the guide means and cartridge-holding means from the first condition to the ready-to fire condition moves the interposed means into a position relative to the cartridge-holding means at which the interposed means retainably holds a cartridge placed within the bore of the cartridge-holding means in its operative position for firing;

the interposed means is adapted to be struck by the forward end of the firing means as the firing means is moved from its first position to its second position so that the impact of the hammer is transferred to the rear of the cartridge through the interposed means; and the interposed means includes a resiliently flexible member spanning the rear of the cartridge placed within the cartridge-holding means when the guide means and cartridge-holding means are positioned int he ready-to-fire condition so that the member is permitted to flex when struck by the forward end of the firing means as aforesaid.

2. The improvement of claim 1 wherein the retaining means is supposedly connected to the guide means.

3. The improvement of claim 1 wherein the resiliently flexible member is a platen which is permitted to flex when struck by the forward end of the firing means as aforesaid.

4. The improvement of claim 3 wherein the guide means includes a body having a forward end positioned adjacent to the cartridge-holding means when the guide means and cartridge-holding means are positioned in the ready-to-fire condition and the retaining means includes securement means associated with the resilient platen for securing the platen across so as to span the forward end of the body of the guide means.

5. The improvement of claim 3 wherein the cartridge-holding means has a body having a substantially planar surface which generally faces the resilient platen of the interposed means, the bore of the cartridge-holding means opens out of the planar surface, a portion of the cartridge adjacent the rear thereof protrudes slightly out of the bore when the cartridge is operatively positioned therein, and the resilient platen has a periphery which contacts the planar surface when the guide means and cartridge-holding means are in the ready to fire condition and has a surface which faces the body of the cartridge-holding means which is concave in form as a path is traced across the platen surface to accommodate the portion of the cartridge which protrudes out of the bore when the cartridge is operatively positioned therein.

6. In a hammer-actuated, powder-activated fastening tool having a tubular housing within which a fastener is positionable, cartridge-holding means including a bore for holding a powder cartridge inserted nose-end first within the bore to a seated condition therein for discharge of the cartridge, guide means associated with the housing and including a body positionable adjacent to the cartridge-holding means, an elongated firing pin for transferring the impact of a hammer to the cartridge and being slidably mounted within the body of the guide means for movement between a retracted position at which the forward end of the firing means is spaced from the rear of the cartridge and an advanced position at which the forward end of the firing pin discharges the cartridge, the guide means being movable relative to the cartridge-holding means between a retracted position accommodating the loading of the cartridge-holding means with a cartridge and an advanced position at which the guide means is disposed adjacent the cartridge-holding means in a ready-to-fire condition and wherein the rear of the cartridge is adapted to be struck in order to discharge the cartridge, the improvement comprising:

retaining means associated with the guide means for abutting the rear of a cartridge positioned within the bore of the cartridge-holding means when the guide means is moved from its retracted position to its advanced position to maintain the cartridge in a seated condition within the bore of the cartridge-holding means until discharged;

retaining means includes means interposed between the forward end of the firing pin and the cartridge-holding means so that a cartridge positioned within the ore of the cartridge-holding means is maintained in a seated condition therein by the interposed means;

the interposed means is adapted to be struck by the forward end of the firing pin as the firing pin is moved from its retracted position to its advanced position so that the impact of the hammer is transferred to the rear of the cartridge through the interposed means; and the interposed means includes a resilient flexible member spanning the rear of a cartridge placed within the cartridge-holding means when the guide means and cartridge-holding means are positioned in the ready-to-fire condition to accommodate a flexure of the member when struck by the forward end of the firing pin as aforesaid.

7. The improvement of claim 6 wherein the retaining means is supportedly connected to the guide means.

8. The improvement of claim 6 wherein the resilient flexible member is a platen which is adapted to flex when struck by the forward end of the firing pin as aforesaid.

9. The improvement of claim 8 wherein the guide means includes a body having a forward end positioned adjacent the cartridge-holding means when the guide means and cartridge-holding means are positioned in the ready-to-fire condition and the retaining means includes a securement section associated with the resilient platen for securing the platen across so as to span the forward end of the body of the guide means.

10. The improvement of claim 8 wherein the cartridge-holding means has a body having a substantially planar surface which generally faces the resilient platen of the interposed means, the bore of the cartridge-holding means opens out of the planar surface, the rear of the cartridge protrudes slightly out of the bore when the cartridge is seated therein, and the resilient platen has a periphery which contacts the planar surface when the guide means and cartridge-holding means are in the ready-to-fire condition and is slightly concave in form as a path is traced across the platen between diametrically opposed locations along the platen periphery to accommodate the protrusion of the rear of the cartridge out of the bore when the cartridge is seated therein.

11. In a hammer-actuated fastening tool utilizing a powder cartridge for driving a fastener into a workpiece upon discharge of the cartridge including a housing within which a fastener is positionable, cartridge-holding means supported within the housing defining a bore within which a cartridge is operatively positionable, elongated firing means for transferring the impact of a hammer to the cartridge for discharging the cartridge wherein the firing means has a rear end for receiving the impact of a hammer and an opposite forward end, means for guiding the firing means relative to the cartridge-holding means from a first position to a second position at which the impact of the hammer is transferred to a cartridge positioned within the cartridge-holding means through the forward end of the firing means to discharge the cartridge and wherein the powder cartridge has a rear which is adapted to be struck in order to discharge the cartridge, the improvement comprising:

retaining means supported within the housing for maintaining the cartridge in its operative position within the bore of the cartridge-holding means until discharged;

the guide means and cartridge-holding means are movable relative to one another from a first condition accommodating the placement of the cartridge within the bore of the cartridge-holding means to a ready-to-fire condition at which the guide means is positioned adjacent the cartridge-holding means so that the firing means is positioned relative to the cartridge in its first position;

the retaining means includes a member interposed generally between the forward end of the firing means and the cartridge-holding means so that movement of the guide means and cartridge-holding means from the first condition to the ready-to-fire condition moves the interposed member into a position relative to the cartridge-holding means at which the interposed member spans the rear of the cartridge placed within the cartridge-holding means and retainably holds a cartridge placed within the cartridge-holding means in its operative position for firing; and the interposed member has two opposite side edges which are secured to the guide means so that as the guide means and cartridge-holding means are moved from the first condition to the ready-to-fire condition, the side edges of the interposed member are prevented from shifting longitudinally with respect to the guide means.

12. The improvement as defined in claim 11 wherein the interposed member possesses a degree of flexibility.

13. The improvement as defined in claim 11 wherein the interposed member is adapted to be struck by the forward end of the firing means as the firing means is moved from its first position to its second position so that the impact of the hammer is transferred to the rear of the cartridge through the interposed means.

14. The improvement as defined in clam 13 wherein the interposed member is permitted to flex when struck by the forward end of the firing means as aforesaid.

* * * * *